US008123350B2

(12) United States Patent
Cannell et al.

(10) Patent No.: US 8,123,350 B2
(45) Date of Patent: Feb. 28, 2012

(54) COMPUTERIZED APPARATUS AND METHOD FOR APPLYING GRAPHICS TO SURFACES

(75) Inventors: Robert L. Cannell, McKinney, TX (US); Alan Hudd, Bourn (GB); Richard Wilkinson, Cambridge (GB); James Fox, Cambridge (GB)

(73) Assignee: Hexagon Metrology AB, Nacka Strand (SE)

( * ) Notice: Subject to any disclaimer, the term of this patent is extended or adjusted under 35 U.S.C. 154(b) by 151 days.

(21) Appl. No.: 12/100,988

(22) Filed: Apr. 10, 2008

(65) Prior Publication Data

US 2008/0252671 A1 Oct. 16, 2008

Related U.S. Application Data

(60) Continuation-in-part of application No. 11/386,180, filed on Mar. 22, 2006, now abandoned, which is a division of application No. 10/858,104, filed on Jun. 1, 2004, now Pat. No. 7,044,665.

(60) Provisional application No. 60/911,711, filed on Apr. 13, 2007, provisional application No. 60/475,409, filed on Jun. 3, 2003.

(51) Int. Cl.
*B41J 3/36* (2006.01)

(52) U.S. Cl. ..... 347/109

(58) Field of Classification Search ..... None
See application file for complete search history.

(56) References Cited

U.S. PATENT DOCUMENTS

| | | | | |
|---|---|---|---|---|
| 3,422,325 | A * | 1/1969 | Gerber et al. | 318/574 |
| 4,547,786 | A | 10/1985 | Logan et al. | |
| 4,937,678 | A | 6/1990 | Murai et al. | |
| 5,805,289 | A * | 9/1998 | Corby et al. | 356/613 |
| 5,935,657 | A | 8/1999 | Cannell et al. | |

(Continued)

FOREIGN PATENT DOCUMENTS

FR 2601265 A1 1/1988

OTHER PUBLICATIONS

Derwent Title and Abstract for US 7,568,373 B2.*

(Continued)

*Primary Examiner* — Matthew Luu
*Assistant Examiner* — Justin Seo
(74) *Attorney, Agent, or Firm* — Knobbe, Martens, Olson & Bear, LLP

(57) ABSTRACT

A system and method for applying an image to a substrate surface are disclosed. The method comprises receiving a set of color matrix maps representing color pixel overlays forming the image, effecting a positioning of a print head array relative to the substrate surface, the print head array comprising at least one print head having a plurality of nozzles, receiving real-time geometry data representing the print head array position and orientation in space, determining, in response to the real-time geometry data, the print head array position and orientation relative to the substrate surface, determining, in response to the print head array position and orientation relative to the substrate surface and the set of color matrix maps, a set of pixels to be applied by the print head array to the substrate surface, and generating instructions to the print head array, in response to the set of pixels to be applied, to actuate particular nozzles in the print head array to apply the set of pixels to the substrate surface.

20 Claims, 10 Drawing Sheets

U.S. PATENT DOCUMENTS

| | | | | |
|---|---|---|---|---|
| 5,944,893 | A | 8/1999 | Anderson | |
| 6,295,737 | B2 | 10/2001 | Patton et al. | |
| 6,319,555 | B1 | 11/2001 | Anderson | |
| 6,398,869 | B1 | 6/2002 | Anderson | |
| 6,467,978 | B1 | 10/2002 | Tideman, Jr. | |
| 6,736,502 | B2 | 5/2004 | Deguchi | |
| 6,832,864 | B2 | 12/2004 | Patton et al. | |
| 6,942,402 | B1 * | 9/2005 | Slupe et al. | 400/88 |
| 7,044,665 | B2 | 5/2006 | Cannell et al. | |
| 7,568,373 | B2 * | 8/2009 | McMurtry et al. | 73/1.81 |
| 2001/0003871 | A1 | 6/2001 | Patton et al. | |
| 2002/0087233 | A1 | 7/2002 | Raab | |
| 2002/0138228 | A1 | 9/2002 | Faulkner et al. | |
| 2003/0086603 | A1 | 5/2003 | Davidson et al. | |
| 2004/0247358 | A1 | 12/2004 | Cannell et al. | |
| 2005/0073541 | A1 * | 4/2005 | Kimura | 347/15 |
| 2006/0165462 | A1 | 7/2006 | Cannell et al. | |
| 2007/0163136 | A1 * | 7/2007 | Eaton | 33/505 |

OTHER PUBLICATIONS

PCT U.S. International Searching Authority, Notification of Transmittal of the International Search Report and the Written Opinion of the International Searching Authority, or the Declaration, International Application No. PCT/US08/59988, Alexandria, VA, Jul. 30, 2008.

* cited by examiner

COMPUTERIZED APPARATUS AND METHOD FOR APPLYING GRAPHICS TO SURFACES

RELATED APPLICATIONS

This application is a continuation-in-part application of Ser. No. 11/386,180 filed on Mar. 22, 2006, which is a divisional of U.S. Pat. No. 7,044,665 entitled Computerized Apparatus and Method for Applying Graphics to Surfaces, issued to Cannell on May 16, 2006, which claims the benefit of provisional application Ser. No. 60/475,409, filed Jun. 3, 2003. This application also claims the benefit of provisional patent application Ser. No. 60/911,711 filed on Apr. 13, 2007. All of these related applications and patents are incorporated herein by reference.

BACKGROUND OF THE INVENTION

1. Field of the Invention

The invention is directed generally to apparatus and methods for painting or printing graphics onto walls, ceilings, floors or surfaces of non-planar or curvilinear substrates. More specifically, the invention relates to computerized apparatus and methods for applying graphics to surfaces.

2. Description of Related Art

A popular means for varying the appearance of a dwelling, storefront or other building is the application of murals or other graphic displays to a wall, ceiling or floor. The owner can customize a design or picture that adds variety to a living space or provokes conversation among guests and customers. The design is then either painted directly onto the desired surface by an artist or painted onto a material that is applied to the surface. Unfortunately, artists that can reliably paint designs onto a wall or other surface are expensive and the process can take weeks or months to complete.

Previous inventions have attempted to simplify the painting of walls, floors and ceilings. U.S. Pat. No. 5,935,657, to Melendez, discloses an apparatus for painting walls that uses adjustable sets of spray nozzles supplied by a pressurized paint source. The apparatus is mounted on wheels and can be manually pushed across the surface of a wall. The use of the nozzles ensures even painting of the surface. The invention is designed for painting a single color onto a wall and does not allow for customized designs to be painted. Only a single color and horizontal/vertical orientation of each set of nozzles may be altered. Additionally, the apparatus uses multiple stationary paint nozzles, spaced in such a way that an entire section of the painting surface may be covered without gaps in a single pass. Movement of the apparatus is not automated, and it must be manually pushed across the width of the surface being painted.

U.S. Pat. Nos. 6,398,869, 6,319,555 and 5,944,893, to Anderson, attempt to automate movement of the painting device and to provide more customized coloration. The patents claim aspects of a specific print head device, in which paint is applied to an elongated filament and then blown from the filament onto a printing medium, such as vinyl, paper or plastic film. The patents disclose the possibility of using a rigid frame on which the printing device can be mounted. The patents also disclose the computerized control of the direction and coloration of printing performed by the particular print head.

The Anderson inventions are not usable for painting walls, floors or ceilings. The rigid frame disclosed in the patents' dicta seems to be a simple mount for the print head and does not control or possibly even allow movement of the print head about the frame. The rigidity of the frame mount prevents adaptability to surfaces of varying widths and lengths. No features are described that would maintain or vary the distance of the print head from a wall to avoid obstacles in the path of the print head. The Anderson invention is also unable to print around corners to a second surface at an angle with the first.

Hence, there is a great need in the art for an apparatus and method for applying graphics to surfaces such as walls, floors or ceilings. The apparatus must be portable and readily scalable to apply graphics to surfaces of varying sizes. It must be capable of painting or printing customized graphics communicated to it by a remote or connected computing device. The movement of the printing device across the surface being painted or printed must be automated. It should also be able to account for the topography of the surface and any obstacles, such as door and window frames, electrical outlets and switches, and the like. It should also be able to print seamlessly around corners.

DETAILED DESCRIPTION OF THE INVENTION

Figure 1:
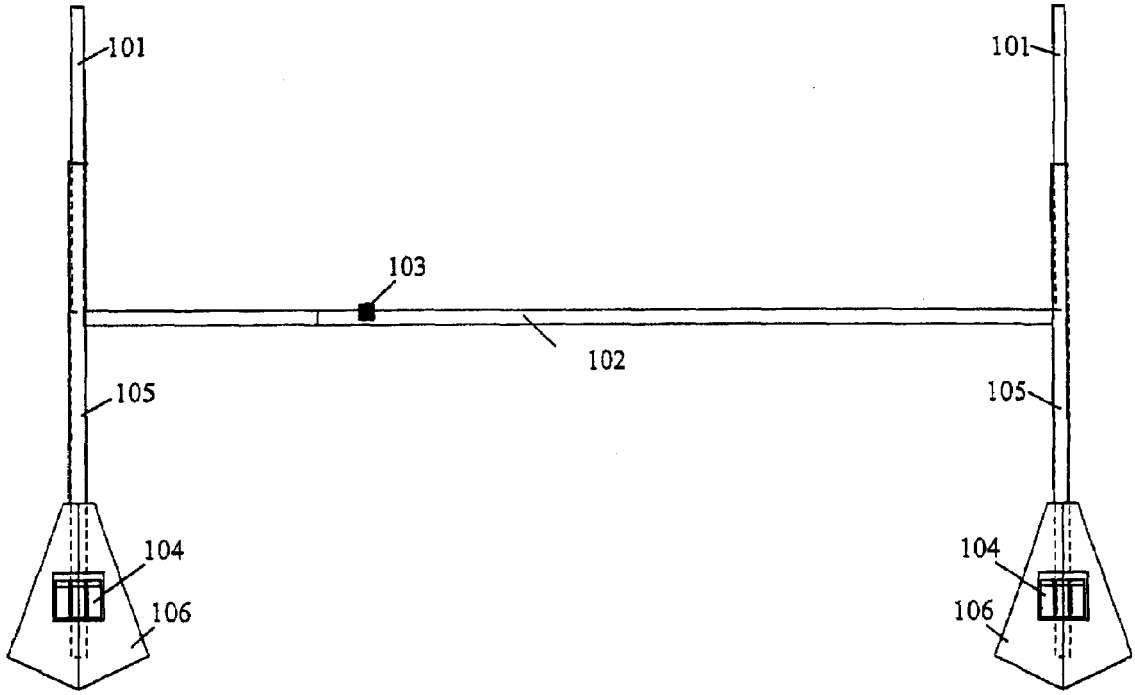
FIG. 1 is an illustration of a first embodiment of an apparatus and method for applying graphics to surfaces.

Referring now to the figures, wherein like elements are indicated by like numerals, an apparatus and method for applying graphics to surfaces, such as a wall, ceiling or floor are shown. As stated previously, the surfaces may be planar or curvilinear where, for example, some bowing, warping or other curvature or inconstancy lies in the shape of the surface. FIG. 1 shows a portable scaffolding system having two vertical members 101. Each vertical member 101 has two elongated portions that may be extended telescopically to accommodate the full height of a wall, when vertical members 101 are perpendicular to a floor; or, to accommodate the length of a floor or ceiling, when vertical members 101 are parallel to the floor or ceiling. The scaffolding also contains at least one horizontal travel bar 102 connected with and perpendicular to the vertical members. The travel bar 102 also has two lengths, such that its length may be telescopically varied to accommodate the width of the printing or painting surface.

Vertical members 101 may be formed of any sturdy material that will not bend or warp in response to tension applied between them or the weight of any parts attached to travel bar 102. Examples of such materials may comprise steel, aluminum or other lightweight metal tubing, as well as poly-vinyl chloride or other suitable plastic tubing. Each vertical member 101 may be formed integrally with a base 105, such that one length of vertical member 101 and base 105 are one piece. Alternatively, they may be formed separately and connected modularly. Preferably, they are formed separately and connected modularly, such that base 106 may be removed when painting or printing a surface that does not require vertical members 101 to stand upright.

The arms of travel bar 102 may be formed of any sturdy material that will not bend or warp in response to the weight of any parts attached to it. Examples of such materials may comprise steel, aluminum or other lightweight metal tubing, as well as poly-vinyl chloride or other suitable plastic tubing. The material used to form travel bar 102 may comprise the same material as that used for vertical members 101. Alternatively, it may comprise a different material than that used for vertical members 101. Alternatively, it may comprise the same material with different thickness or other dimensions than that used for vertical members 101.

Also shown is a host device 103 that is movably attached to travel bar 102. Host device 103 comprises a housing that is adapted to receive one or more head attachments, which may include a print or paint head, or a mapping device, such as an optical sensor. Host device 103 also comprises an electronic step motor that controls the movement of host device 103 across travel bar 102.

Electronic step motors may also be placed in the base of each vertical member 101. The step motors may be used to gradually raise or lower the telescopic arms of vertical members 101. This allows host device 103 to move across the next highest or next lowest line to be mapped, painted or printed on the surface. Paint or ink supplies 104 may also be housed in the base of each vertical member 101, for re-filling a print head that is placed in host device 103.

Figure 2A:
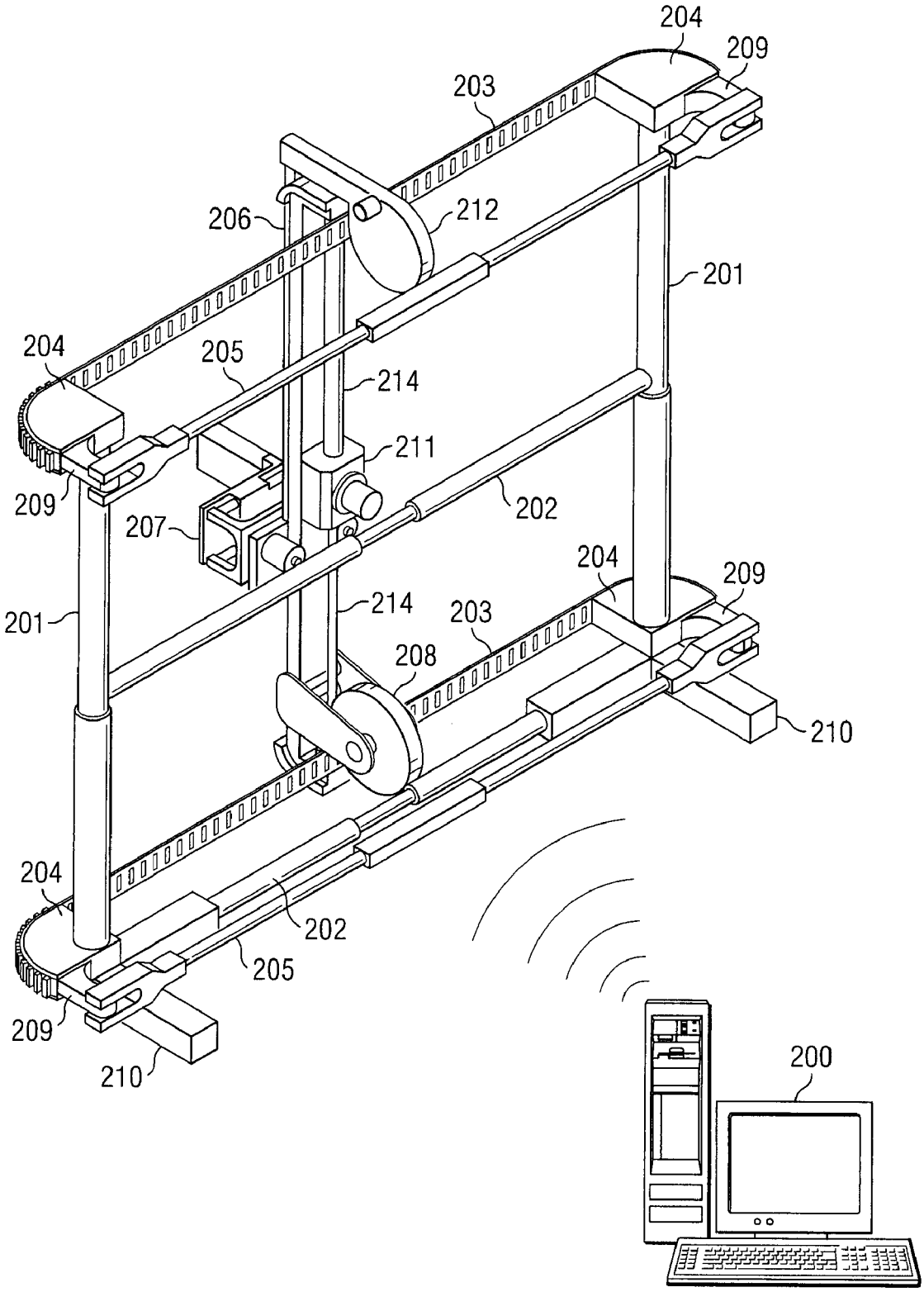
FIG. 2A is an illustration of a rear perspective view of a second embodiment of the apparatus and method for applying graphics to surfaces.

FIG. 2A illustrates a second and preferred embodiment of the apparatus and method for applying graphics to surfaces. FIG. 2A shows a portable scaffolding system having two vertical members 201. Each vertical member 201 is telescopic, such that it may be extended telescopically to accommodate the full height of a wall, when vertical members 201 are perpendicular to a floor; or, to accommodate the length of a floor or ceiling, when the vertical members 201 are parallel to the floor or ceiling. Each vertical member 201 has a proximal end and a distal end, both of which are connected with a tensioning cam 204. Each tensioning cam 204 is oriented such that its teeth face the painting or printing surface and a tensioning arm 209 extends away from the painting or printing surface. The distal end of each vertical member 201 may also be connected with a base 210 for supporting the vertical member 201 on a floor. The base 210 may be square, L-shaped, or any suitable shape for preventing tippage of the scaffolding system.

The scaffolding system also contains at least one horizontal brace 202 connected with and perpendicular to vertical members 201. Each horizontal brace 202 is telescopic, such that its length may be varied to accommodate the width of the printing or painting surface. Preferably, two horizontal braces 202 are used, one about the midpoints of vertical members 201 when they are fully collapsed, and one at the distal ends of vertical members 201 or connected with platforms 209. The scaffolding system may also contain at least one tensioning turnbuckle 205 for maintaining an exact width between vertical members 201. Each tensioning turnbuckle 205 may grip the arms of both tensioning cams 204 at the proximal or distal ends of the vertical members 201. Alternatively, the tensioning turnbuckles 205 may hook around the arms 209 of the tensioning cams 209, thereby pulling the vertical members 201 toward one another.

The scaffolding system also contains at least one travel bar 203. Each travel bar 203 may comprise a flexible strip having evenly spaced apertures for receiving teeth of tensioning cams 204. Each travel bar is stretched between tensioning cams 204 at the proximal or distal ends of vertical members 201. The flexibility of travel bars 203 allows them to be adjusted to the telescoped length of the horizontal braces 202, while maintaining constant dimensions along the lengths of travel bars 203.

Vertical members 201 may be formed of any sturdy material that will not bend or warp in response to tension applied between them or the weight of any parts in contact with to travel bars 203. Examples of such materials may comprise steel, aluminum or other lightweight metal tubing, as well as poly-vinyl chloride or other suitable plastic tubing. Horizontal braces 202 may be formed of any sturdy material that will not bend or warp in response to the tension applied between vertical members 201 by parts attached to travel bars 203 or by tensioning turnbuckles 205. Examples of such materials may comprise steel, aluminum or other lightweight metal tubing, as well as poly-vinyl chloride or other suitable plastic tubing. The material used to form horizontal braces 202 may comprise the same material as that used for vertical members 201. Alternatively, it may comprise a different material than that used for vertical members 201. Alternatively, it may comprise the same material with different thickness or other dimensions than that of vertical members 201.

Tensioning cams 204 may be composed of any sturdy material that will not bend, warp or break in response to the tension of travel bars 203 against their teeth or tensioning turnbuckles 205 against their arms 209. Vertical members 201 may be formed such that tensioning cams 204 are integrated with the ends of vertical members 201. Alternatively, tensioning cams 204 may be separately formed and connected modularly with vertical members 201. Preferably, tensioning cams 204 are integrated with the ends of vertical members 201. Bases 210 may also be integrally formed with the distal end of each vertical member 201. Alternatively, bases 210 may be separately formed and connected modularly with vertical members 201. Preferably, bases 210 are separately formed and connected modularly with vertical members 201, such that platforms 210 may be removed when painting or printing a surface that does not require the scaffolding system to stand upright.

Travel bars 203 may be composed of any flexible material that may stretch and yet not sag or tear in response to the weight of parts that travel bars 203 support. Such materials may comprise rubber or a suitable flexible or semi-rigid polymer material.

Figure 3:
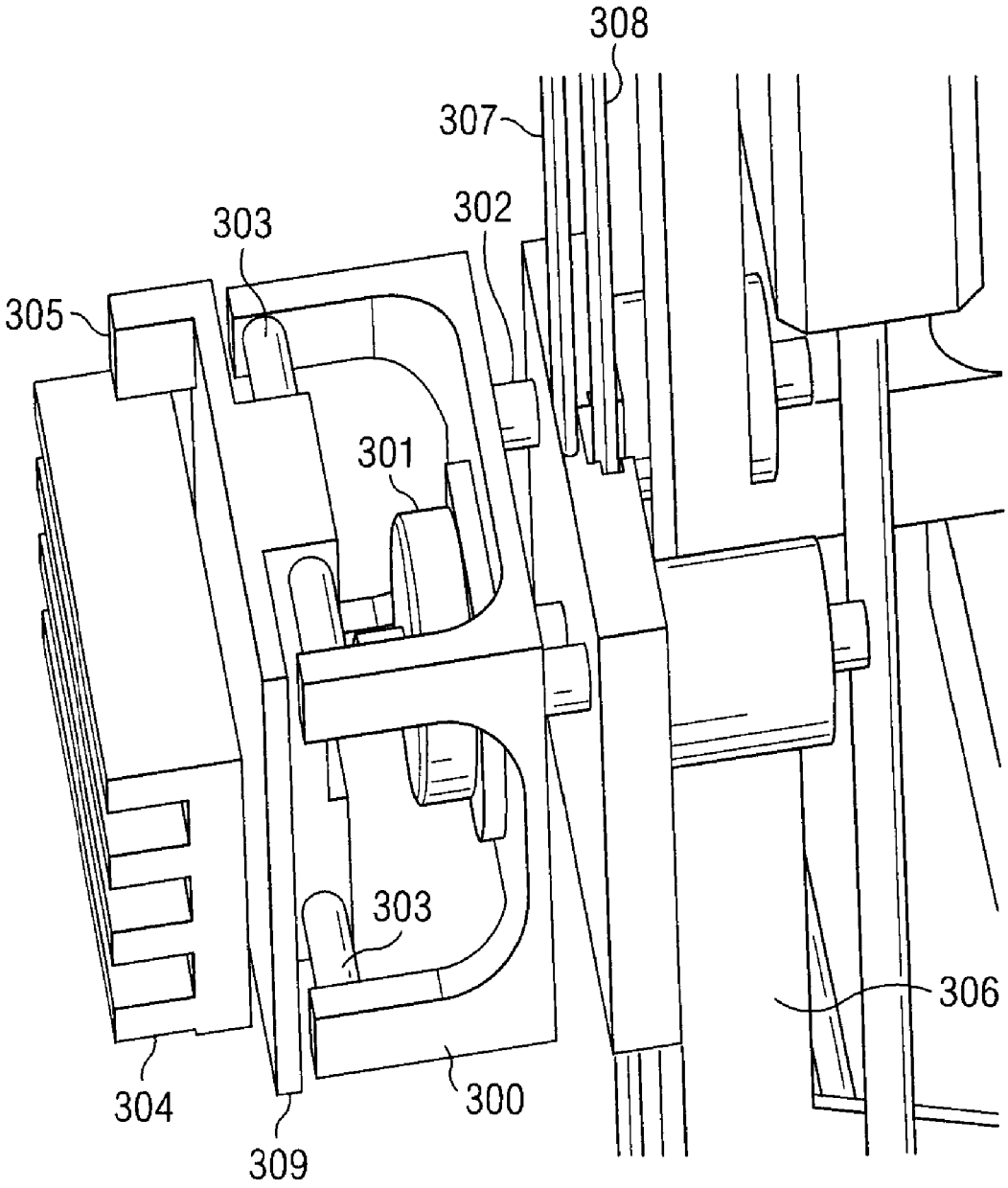
FIG. 3 is an illustration of a side perspective view of a host for receiving and directing a wall printing device, such as a print head or mapping device.

The embodiment shown in FIG. 2A also comprises a host device 207. Host device 207, described in further detail with reference to FIG. 3, is adapted to receive one or more head attachments, which may include a print or paint head, or a mapping device.

Figure 2B:
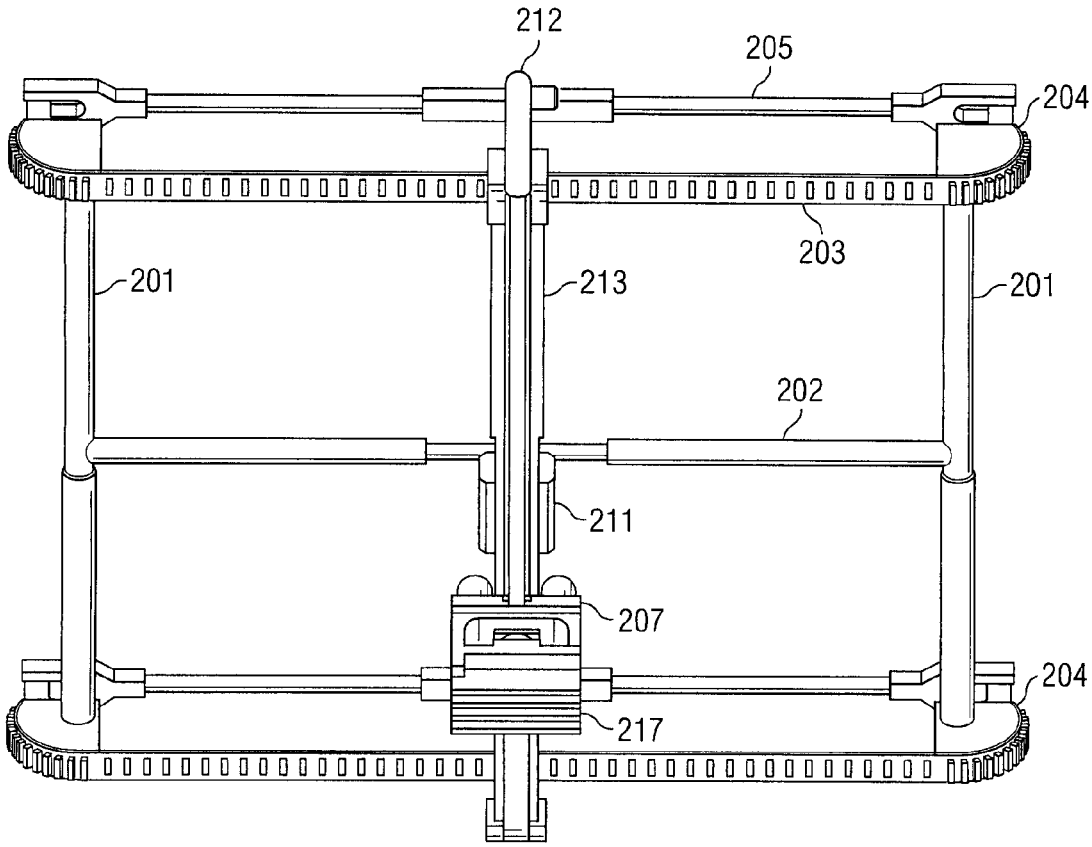
FIG. 2B is an illustration of a front perspective view of a second embodiment of the apparatus and method for applying graphics to surfaces.

The embodiment shown in FIG. 2A also comprises a vertical drive assembly 206 having a vertical track reel 208, a vertical drive motor 212, a horizontal drive motor 211, and a vertical drive belt, shown as 213 in FIG. 2B. Vertical drive belt 213 may comprise a rubber or plastic belt or metal chain and is connected with host device 207. Vertical drive motor 212 moves drive belt 213 about its reel, such that host device 207 moves incrementally in either direction along the length or height of the surface to be painted or printed. Vertical drive motor 212 contains motion control circuitry that receives instructions from a computing device 200 via an electronic drive board, a receiver, an antenna or other suitable communication means.

Horizontal drive motor 211 moves vertical drive assembly 206 horizontally across travel bars 203, in incremental steps along the width of the surface to be painted or printed. Horizontal drive motor 211 contains motion control circuitry that receives instructions from computing device 200 via an electronic drive board, an antenna or other suitable communication means. Horizontal drive motor 211 turns horizontal drive rods 214, simultaneously, in the same direction. Horizontal drive rods 214 contact travel bars 203, either frictionally or with teeth that fit in the apertures of travel bars 203. The turning of horizontal drive rods 214 moves vertical drive assembly 206 across travel bars 203 in incremental steps, according to instructions received from the computing device 200.

Computing device 200 may comprise any suitable computing device for loading, displaying and editing graphic displays, storing and processing wall topography data, and communicating with the horizontal, vertical and host drive motors and other motors requiring instruction, as described herein. Computing device 200 may comprise a desktop or laptop computer or a portable computing device, such as a personal data assistant or pocket PC. Computing device 200 may communicate with the various motors described herein through direct electrical connection or via radio, infrared or other communication means. Preferably, remote communication means is used that does not interfere with other remote devices in a home or other structure, such as electronics equipment, wireless networks or cordless telephones.

FIG. 2B illustrates a front perspective view of an apparatus and method for applying graphics to surfaces. FIG. 2B further illustrates vertical drive assembly 206, by showing a vertical drive belt 213 connected with host device 207. As stated, vertical motor 212 moves host device 207 in a vertical line by retracting and extending vertical drive belt 213 about the reel of vertical motor 212.

Those skilled in the art will recognize that the number of vertical towers used in FIGS. 2A and 2B is not intended to limit the invention's scope. For instance, where painting or printing surfaces are so wide that the travel bars cannot support vertical drive assembly without sagging, additional towers may be used between the towers that frame the width of the painting or printing surface.

FIG. 3 illustrates a side perspective view of the host device, in accordance with the invention. The host device is primarily responsible for maintaining the distance and alignment of a head attachment with respect to a surface to be painted or printed. The host device comprises a housing 300, a motor 301, and guides 302. Motor 301 moves housing 300 toward or away from the painting or printing surface along guides 302. Motor 301 contains motion control circuitry that receives instructions from a computing device via an electronic drive board, receiver, antenna or other suitable communication means. The host device preferably contains at least two equidistant guides 302. Most preferably, the host device contains three guides 302 placed in a triangular configuration, as shown in FIG. 3. The motion of housing 300 moves head attachment 304 toward and away from the painting or printing surface. Guides 302 must be sufficiently long to enable the print head to avoid thick obstacles, such as door and window frames.

The host device also comprises a vertical motion platform 306 that is connected with housing 300 via guides 302. Vertical motion platform 306 connects with vertical drive belt 307 (also shown at 213 in FIG. 2B). Vertical drive belt may be connected with the side of vertical motion platform 306 that faces the vertical drive motor (shown at 212 in FIGS. 2A and 2B). Alternatively, a second vertical drive belt may be attached in line with vertical drive belt 307 on the underside of vertical motion platform 306, such that it moves about the vertical track reel (shown at 208 in FIG. 2A). Vertical motion platform 306 contains a recessed portion for receiving vertical drive track 308, such that host device moves in a straight vertical line along vertical drive track 308, when the vertical drive motor (shown at 212 in FIG. 2A) retracts or extends vertical drive belt 307.

The host device also comprises a horizontal motion platform 309, which moves across guiderails 303. Guiderails 303 are parallel and connected with the corners of housing 300 as shown. Guiderails 303 enable horizontal motion platform 309 to move horizontally along them to reach areas of the painting or printing surface that are unreachable due to the position of the vertical drive assembly. For instance, when horizontal movement of the vertical drive assembly is prevented by either vertical tower, guiderails 303 allow the print head to continue moving horizontally. This prevents the width of the painting or printing surface from being reduced by the width of the towers or bases of the towers.

Head attachment 304 is removably and pivotally attached with horizontal motion platform at corner swivel 305. As stated, head attachment 304 may comprise a paint head, print head, or mapping device. Mapping devices may comprise an optical sensor, laser sensor, camera or other suitable device for mapping surface topography, and may include illumination devices. Head attachment 304 may be pivoted about swivel 305, in order to paint, print or map around corners or angles, and continue printing, painting or mapping adjoining surfaces. This is shown and described in further detail with reference to FIG. 4.

The print or paint heads used in accordance with the present invention may comprise any industrial paint or print head suitable for printing graphics of the scale necessary to cover surfaces such as walls, ceilings or floors. Preferably, the print or paint head should be capable of holding a sufficient amount of colorant to prevent frequent refilling during painting or printing of a single surface. The print head also contains motion control circuitry that receives instructions from a computing device via an electronic drive board, an antenna or other suitable communication means, such that the print or paint head can move about guiderails on the host device, as described herein. The print head may also contain mapping devices, such that it maps a surface entirely without switching devices, or such that it maps the surface on the fly, a certain number of horizontal and vertical lines ahead of printing or painting. The print head may also be separate from the mapping device but have a sensor for verification of the topography during printing or painting. Preferably, the surface is mapped entirely by a separate mapping device, such that degradation of the mapping device or print head will not necessitate replacement of both devices. Preferably, the print head has a sensor for verifying topography on the fly.

Figure 4:
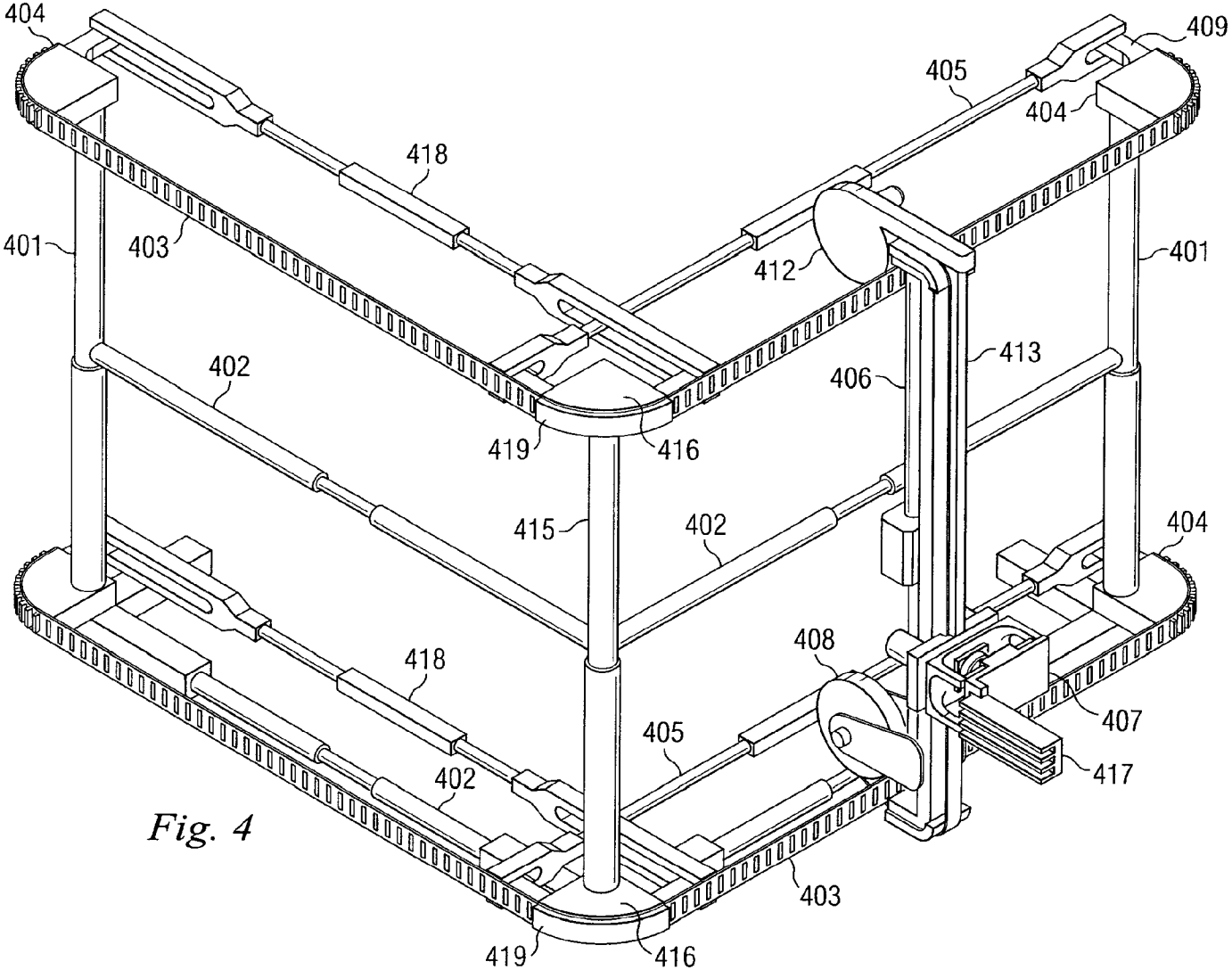
FIG. 4 is an illustration of a two-wall embodiment of the apparatus and method for applying graphics to surfaces.

FIG. 4 illustrates a two-surface embodiment of an apparatus and method for applying graphics to surfaces. The two-surface embodiment employs the same features as the single-surface embodiments described previously, with additional elements. This embodiment will be described for walls that form right angles with each other, though those skilled in the art will appreciate that the embodiment may be used for walls, ceilings and floors that form different angles or which have concave rounded corners. Vertical members 401 are separated from each other by two horizontal braces 402 that are connected at a right angle via midpost 415. Vertical members 401 and midpost 415 are all connected or integrated with tensioning cams 404 and 416, respectively, which support horizontal travel bars 403. Tensioning cams 416 differs from tensioning cams 404 in that they have two arms 409 for supporting tensioning turnbuckles 405 and 418. Tensioning turnbuckles 418 also differs from tensioning turnbuckles 405, in that they must be able to extend past tensioning turnbuckles 405 to the opposite arm of tensioning cam 416, while remaining parallel to horizontal braces 402.

FIG. 4 illustrates head attachment 417 connected with and perpendicular to host device 407. This is the second-surface position for head attachment 417. In order to align the image on a first wall or surface with that on the adjoining wall or surface, print head 417 extends into the second-surface position, when it reaches the corner between the surfaces. It prints or paints fiducial marks on the second surface that act as guidemarkers for the continuation of the graphics being painted or printed on the first surface. When the second surface is mapped for painting or printing, the mapping device detects the fiducial marks and communicates them to the computing device that instructs the various motors, as described previously. This allows the computing device to instruct the vertical, horizontal and print head motors to paint or print graphics that are aligned with the image on the first surface.

Once printing or painting of the first surface is completed, vertical drive assembly 406 can either be manually replaced onto those travel bars 403 that face the second surface, or vertical drive assembly may automatically transition around the corners. Preferably, vertical drive assembly 406 automatically transitions around the corners. The horizontal drive rods (shown as 214 in FIG. 2A) of vertical drive assembly 406 disengage with those travel bars 403 facing the first surface, engage corner guides 419, which cover the teeth of midpost cams 416, and then engage those travel bars 403 facing the second surface.

Figure 5:
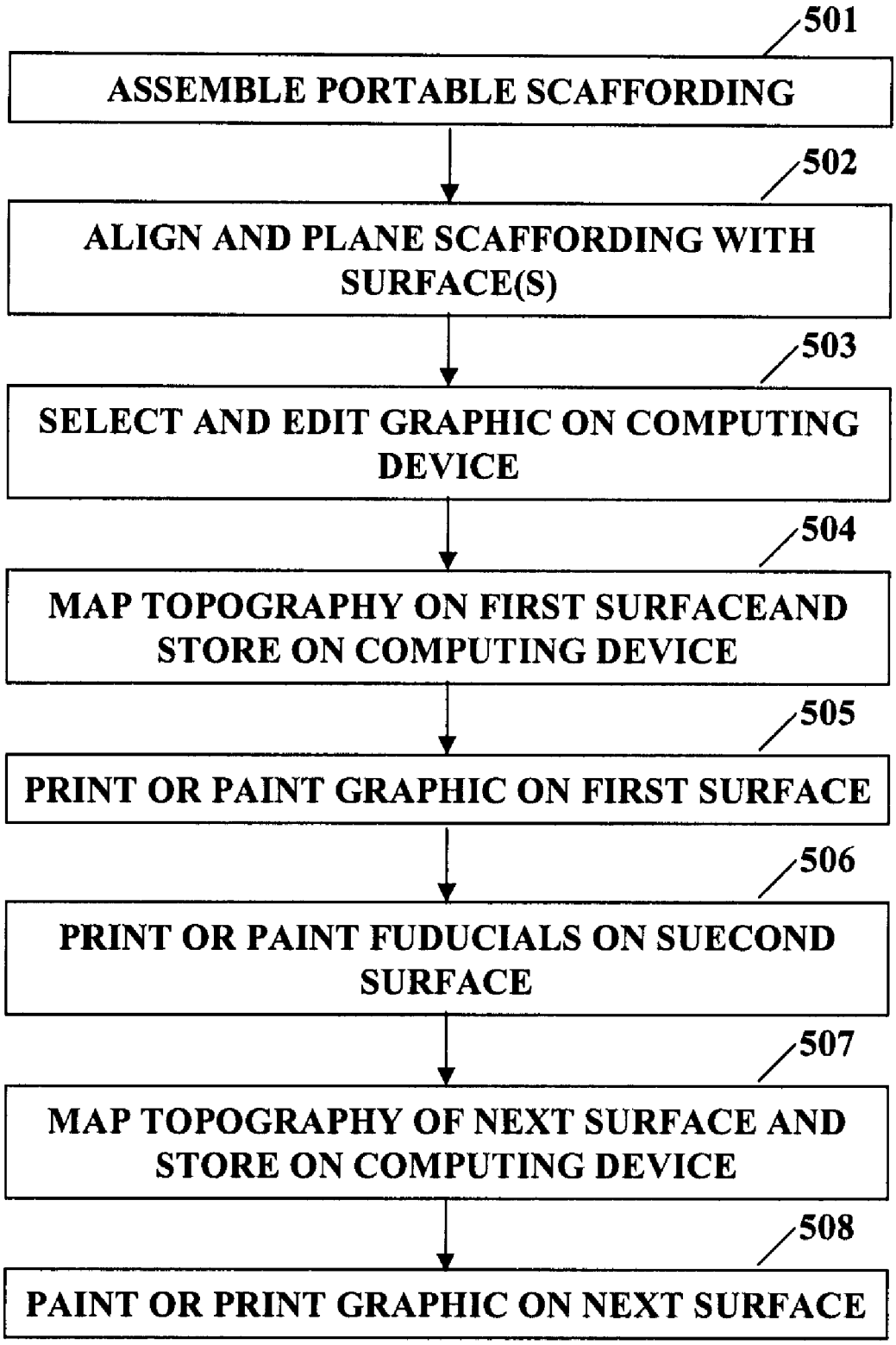
FIG. 5 is a flow diagram illustrating steps for a method of using the apparatus and method for applying graphics to surfaces.

Described hereinafter is a computer-implemented method of painting or printing a graphic on surfaces, such as walls, floors or ceilings. As stated previously, the surfaces may be planar or curvilinear where, for example, some bowing, warping or other curvature or inconstancy lies in the shape of the surface. FIG. 5 illustrates exemplary steps of the computer-implemented method. In accordance with step 501, a portable scaffolding system of any type disclosed herein is assembled such that a head attachment will face the surface to be painted or printed when it is attached to the host device. In accordance with step 502, the scaffolding system is aligned and planed, such that it will paint or print a graphic level with the plane occupied by the surface. Alternatively, the scaffolding system may be aligned with the surface but planed at an angle with the surface, such that the graphic is printed or painted on the surface at a constant angle. If a second wall is to be painted or printed, then the two-surface embodiment of the current invention may be aligned or planed with each surface.

In accordance with step 503, at least one graphic is received into random access memory of a computing device. The graphics may be selected from a database of graphics that is stored on the computing device or on a remote computing device that communicates with the computer via a local area network, a wide area network, or via the Internet. The selected graphics may be edited via the computing device, if necessary. Where two walls are painted or printed, the selected graphics may the same, different or continuations of each other.

In accordance with step 504, the topography of the surface to be painted or printed is mapped. A wall mapping device is attached to the host device of the scaffolding system, as described herein. The host device then steps across the surface to be painted or printed in horizontal or vertical lines and communicates the presence of obstacles and varying thicknesses on the surface. Where the host device is prevented from further movement, the host device moves across guiderails on the host device to access the full width of the surface, as described herein. The wall mapping device communicates data to the computing device for mapping the surface.

In accordance with step 505, a selected graphic is painted or printed onto the first surface. A print or paint head is attached with the host device of the scaffolding system, as described herein. The computing device communicates with the print or paint head and instructs it to emit colorants of varying colors, while communicating with motors that control the horizontal and vertical motion of the host device and the distance of the host device from the surface. It also communicates with the paint or print head to move along the disclosed guiderails when the movement of the host device is obstructed by the vertical members of the scaffolding system or other obstacles. Where two surfaces are being painted or printed, fiducials are painted or printed onto the second surface, in accordance with step 506. These fiducials may be painted or printed periodically, after each line or a number of lines has been printed on the first surface, or they may be printed or painted after the graphic is completed on the first surface. Alternatively, they may all be printed before the first surface is printed. Preferably, they are painted or printed periodically, after each of a certain number of lines are printed on the first surface.

In accordance with step 507, the topography of the next surface is mapped. A wall mapping device is attached with the host device and steps across the length and height of the next surface. In addition to communicating obstacles along the next surface to the computing device, it communicates the position of the fiducials painted or printed in step 506 to the computing device. In this way, the computing device may produce motions in the host device and print head that will yield alignment of the graphics on each surface. In accordance with step 508, the next surface is painted or printed in like manner to the first surface.

Figure 6:
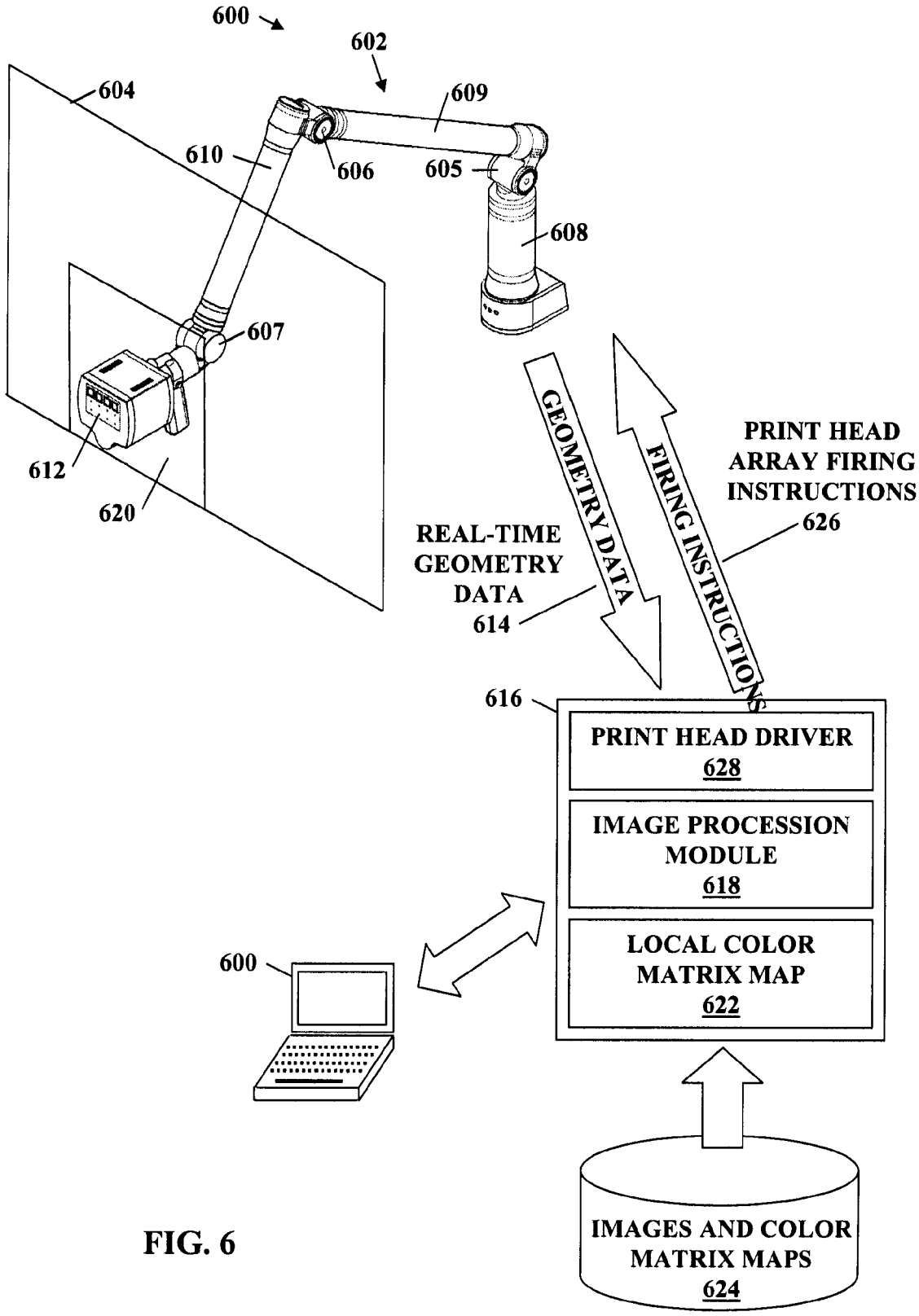
FIG. 6 is a high-level logical block diagram of another embodiment of the system using a portable coordinate measurement machine (PCMM) for applying graphics to surfaces.

FIG. 6 is a high-level logical block diagram of another embodiment of a system 600 using a portable coordinate measurement machine (PCMM) 601 in the form of a multi-axial articulated arm 602 for applying graphics to surfaces, such as a vertically-oriented wall or substrate 604. Substrate 604 can be any surface upon which a graphics image is to be applied, and can be planar, non-planar or irregular in shape or orientation. Therefore, the substrate surface may be walls, ceilings, floors, the wings of an airplane, the side panels of a vehicle, for example. The system and method described herein can precisely place colorants to form the desired graphics and image on these surfaces or a portion of these surfaces. PCMM 602 is a piece of equipment traditionally used in the automotive, aerospace, and other industries for inspection and measurement tasks on the shop floor or in the metrology lab. An example of a PCMM that may be used in system 600 is one manufactured by Romer, Inc. of Wixom, Mich. As described in more detail below, PCMM 601 is required to generate geometry data of the multi-axial arm at a very high rate as the free end of the arm is advanced along the contours of the substrate surface. PCMM arm 602 includes a first, second and third articulated joints 605-607 connecting first, second and third arm members 608-610. Each articulated joint has multiple axes of movement. For example, first and second joints 605 and 606 each has two axes of movement, and third joint 607 has three axes of movement. The three axes of movement of third joint 607 enables a print head array 612 held at the free-end of PCMM arm 602 to be suitably oriented relative to the print substrate.

Figure 7:
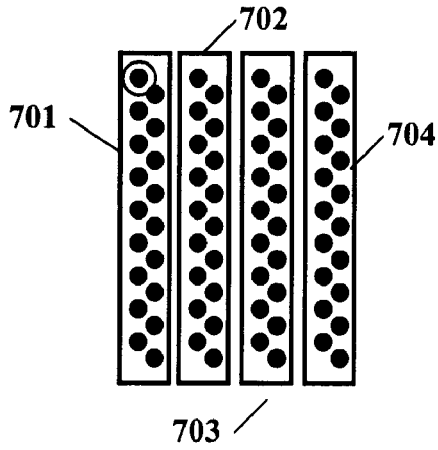
FIG. 7 is a schematic representative of an embodiment of a print head array.

PCMM 601 additionally includes a coordinate processor and suitable software that are operable to determine, in real-time, the three-dimensional (3D) geometry of the free-end of the arm where the print head array is held. In one embodiment, real-time geometry data 614 includes the X, Y, and Z coordinate of the free-end of the PCMM arm, and angles A, B, and C, representing the angles relative to the X, Y, and Z axes, respectively. This set of real-time geometry data 614 represents the print head array's position and orientation relative to space, and is provided to a print processor and software 616 that use the received real-time PCMM arm geometry data to determine, also in real-time, which color colorants are to be applied by which print heads 701-704 in print head array 612, shown in FIG. 7. Each print head 701-704 is assigned a particular colorant, such as cyan, magenta, yellow, and black, and is operable to eject or apply a measured amount of colorant in the assigned color via a plurality of print nozzles. Using interchangeable print heads in the print head array, the system and method described herein can be used for applications in which textures or electro conductive materials are applied to the substrate surfaces. It may be seen that the nozzles are arranged in a predetermined configuration or pattern on each print head. Although print head array 612 is shown with four color print heads 701-704, other printing systems with any number of colors can also be implemented in this manner. Print processor and software 616 includes, but are not limited to, an image processing module 618 which receives the real-time geometry data 614 from PCMM 601 and determine the print head array position and orientation relative to a print region 620 defined on substrate surface 604. Print region 620 is a work area on substrate surface 604 that the current position of PCMM arm 602 can effectively reach and apply the colorant without moving the temporarily fixed-end or base of the arm. Therefore, a substrate surface 604 to be printed is composed of one or more print regions 620 that may or may not overlap.

Because the precise real-time location and orientation of the print head array can be determined, the operator is not required to heed to a particular application format, such as only left-to-right and top-to-bottom. However, the operator's manual positioning and movement of the print head array attached to the PCMM arm does require a degree of accuracy to achieve complete surface coverage. A small band or gap of unprinted surface would require additional passes by the operator. Further, it may be desirable that the operator moves the print head array smoothly and at a relatively steady rate. In an alternate embodiment, PCMM arm 602 may include actuators that automatically advance, at a prescribed rate and direction, the print head array along a projected path following the contours of the target substrate surface. This embodiment employs a closed loop system in which the real-time geometry data are used to instruct the firing of the print head nozzles as well as advance the print head array.

Figure 8:
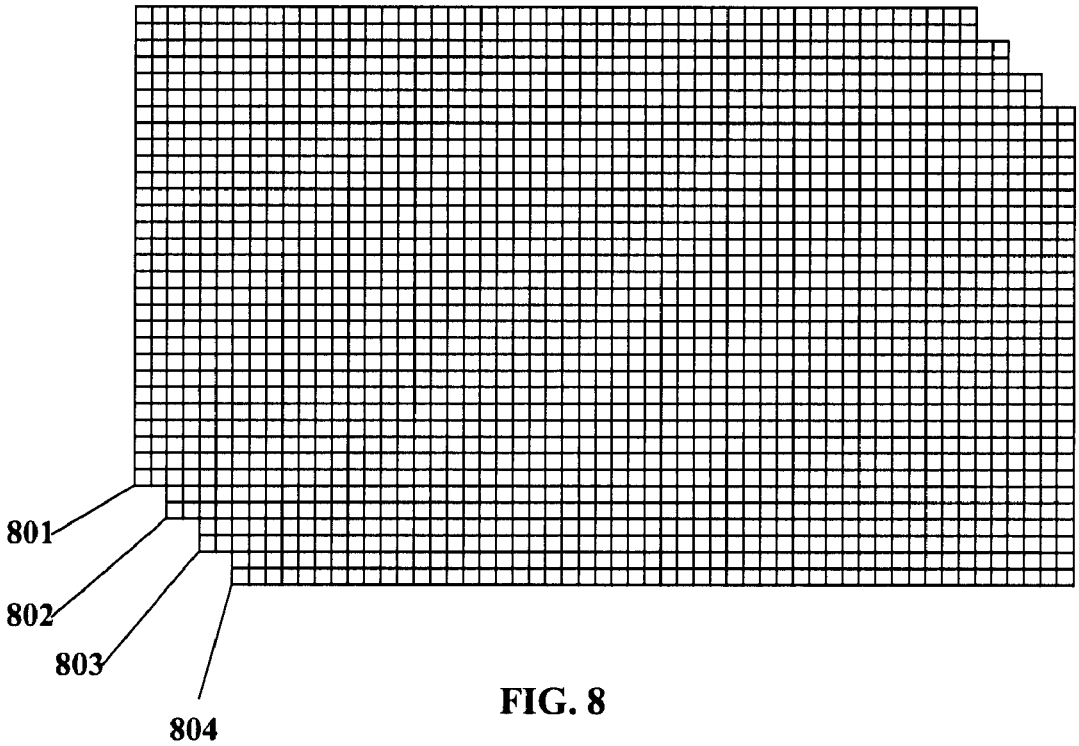
FIG. 8 is a schematic representation of color matrix maps of an image to be applied to the surface.

Print processor and software 616 also includes a memory that stores a local copy of a set of color matrix maps 622 of print regions 620. The local copy of color matrix maps represents a subset of a set of color matrix overlay maps 800 of the entire image, such as shown representatively in FIG. 8. Because real-time processing is required, the smaller set of data in the local copy of color matrix maps enables data to be computed and manipulated in an efficient manner. Nevertheless, in some embodiments a larger portion of the image than a single print swath will be pre-processed into the local copy and the exact data that is printed for each encoder pulse will be selected from all of the data pre-processed, by using the coordinate position of the print head. The image is split into horizontal swaths by a Raster Image Processing engine but each swath of the image is now actually wider than the printable width of the print head. For instance, the print head width may be 300 pixels and the pre-processed swath is made up of the print head width plus a margin both above and below that e.g. 300+100+100 pixels. The size of the margins can be chosen during development to determine the optimum balance of typical operator 'wobble' with the quantity of data to be manipulated. This technique is put in place as it is assumed that a human operator will not be able to draw the arm across the wall in a sufficiently straight line for accurate printing (~25 um accuracy). Using this technique, a row of image data is clocked serially into the head driver for each stroke of the image. A head positioned with no vertical offset will have the data starting from the bottom margin of the swath clocked into the head. When the head is offset vertically, then the data clocked into the head is modified. Even using this technique, it is of course possible for the operator to stray beyond the limits of the pre-processed data occasionally and so this occurrence must be planned for and dealt with by the system. In such a situation, the system simply uses blank data to fill the extra pixels and so no image is printed; any missing print can then be filled in on a subsequent print pass.

Color matrix maps 800 include multiple color matrix maps 801-804, where each color matrix map corresponds to a color to be applied and indicates the locations where the particular colorants are to be applied. Therefore, in the example shown in FIG. 8 for a four-color printing system, four color matrix overlay maps are used to represent the graphics image to be applied to the substrate. Because the PCMM arm can be configured to accept a number of print head arrays, it is possible to have an image with more color layers than the number of simultaneously configurable print heads.

As areas of the print region are printed, the local color matrix maps are updated to so indicate. A database or another form of suitable memory 624 is used to store the color matrix maps of the entire image, as well as other data. As described in more detail below, print head array firing instructions 626 are determined based on the real-time geometry data and the color matrix maps. In other words, knowing the precise location of the print head array relative to the target substrate surface, instructions for applying specific pixels to specific locations are generated and provided to the print head array. Applied in the right location and sequence, the color pixels applied to the substrate surface make up the desired color, and the desired graphical image is achieved.

Print processor and software 616 further includes additional hardware and/or software such as hardware and software 628 for the print head array, for example. A monitor and keyboard, laptop computer, desktop computer, or other computing and user interface devices 630 may be coupled to print processor 616 to enable the operator to study data, receive status feedback, provide operational parameters and other input. It is desirable to have high-speed communication between the various components of system 600, where suitable data protocols may be used in communication media that may be wired or wireless. The processing platforms for both coordinate and print processors may be any suitable device, including, for example, a processor chip, a digital signal processor, a field programmable gate array.

In another embodiment, print processor and software 616 may be resident in a suitable computer 630. In yet another alternative embodiment, the coordinate processor and accompanying software and print processor and software 616 may reside in the same computing platform and be incorporated into the physical configuration of the PCMM arm. Alternatively, the coordinate software and print software may reside on and execute in computer 630 coupled to PCMM arm 602.

Figure 9:
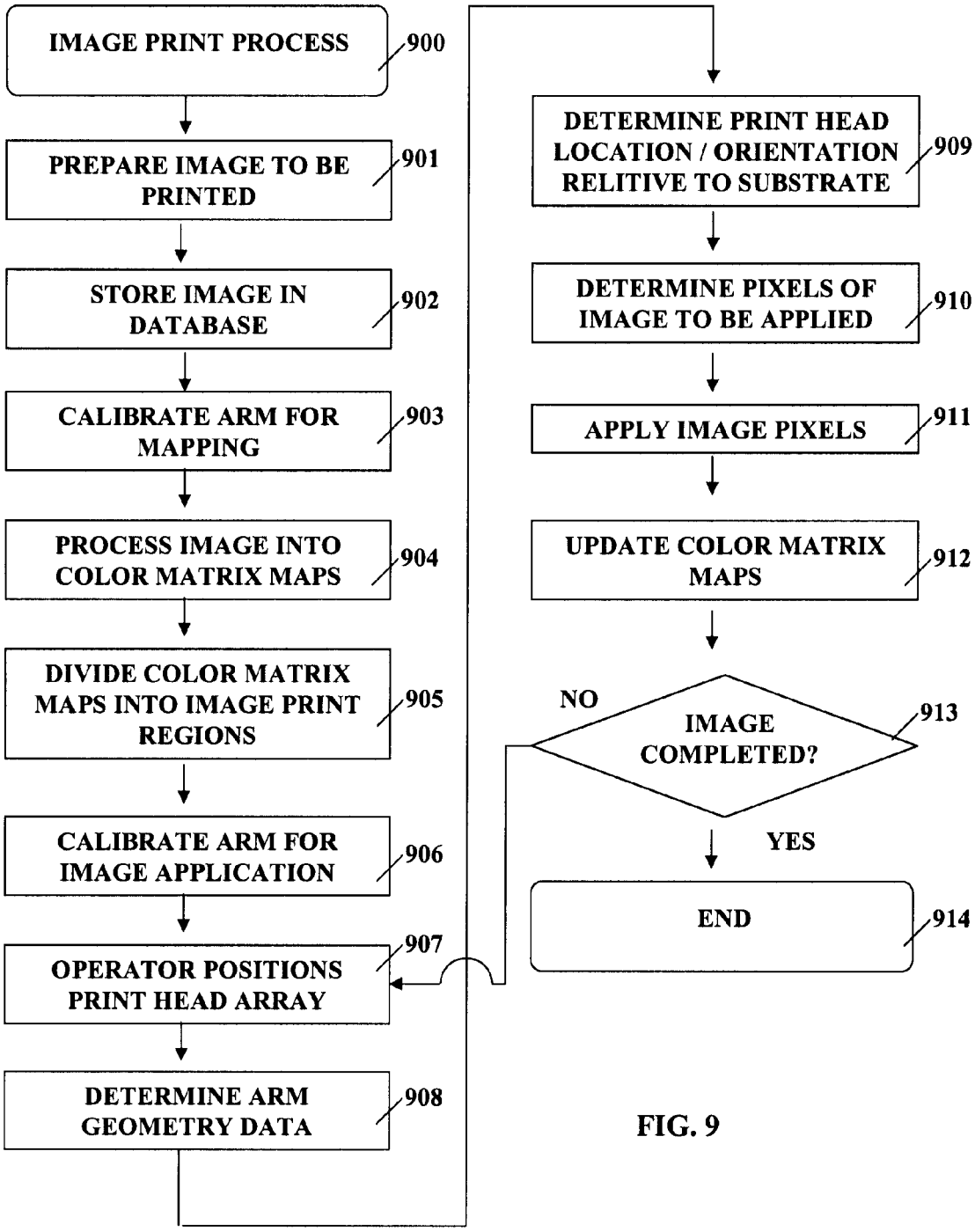
FIG. 9 is a flowchart of an embodiment of a method for applying graphics to surfaces.

FIG. 9 is a flowchart of an embodiment of a method 900 for applying graphics to surfaces. In step 901, the image or images to be applied to the target substrate is prepared, edited and finalized. In step 902, the prepared image or images are stored in a database or memory in a suitable format. Steps 901 and 902 are typically performed off-site in advance of image application. Further, the database may store several graphical images that can be selected by an operator on-site when ready to apply the image to the target substrate.

In step 903, the operator calibrates PCMM arm 602 for mapping the target substrate. A mapping probe (not shown) is used with the PCMM arm to capture the geometry of the substrate surface that is to receive the graphical image. The substrate surface may be planar or non-planar, and can be oriented in any direction. During this step, the position of the arm relative to the target surface is determined so that the two share the same coordinate system. In step 904, the selected image is processed so that a set of color matrix maps representing the precise placement of all the color pixels is generated. The set of color matrix maps include a color matrix map for each colorant to be applied for the image with respect to the substrate surface. In step 905, the color matrix maps are further divided into print regions 620. As described above, each print region represents the work area on the substrate surface that can be reached by the PCMM arm without moving its base or temporarily fixed-end. A suitable algorithm may be used to determine the size and location of the print regions that make up the image, so that the number of times that the PCMM arm has to be positioned and repositioned is minimized.

In step 906, the arm is again calibrated but with the print head array installed on the free-end of the PCMM arm. In step 907, the operator positions the print head array at a starting location of a print region and provides input, via device 628, to initiate image application. In step 908, real-time geometry data is determined by PCMM 601 and received by print processor and software 616. The coordinate processor and software may make the computation in one of two ways: empirically or by interpolation. In an empirical computation cycle, the real-time geometry data are computed from the axes of rotation at the joints of the PCMM arm. In an interpolated cycle, the real-time geometry data are determined based on one or more sets of prior geometry data. For example, in an interpolated cycle, the six data values (X, Y, Z, A, B, C) are based on the results of an immediately prior empirical cycle and predicted delta values. The predicted delta values may be determined based on a vector representing the direction and speed of movement by the print head array.

In step 909, the print head array position and orientation relative to the target substrate surface are determined based on the real-time geometry data. The determination made in this step includes the determination of each nozzle's position. The nozzle's position can be computed using a number of methods, including a vector travel method, in which the nozzle position is updated when the X and Y values change by a predefined amount. Another method computes the new nozzle positions based on any change in the six data values. Yet another method uses a table storing a plurality of prestored values, so that the position of a particular nozzle can be identified from the table based on the six geometry data values. Process 900 may employ a combination of these methods to determine the nozzle position and orientation. As each print head array includes multiple print heads, and each print head includes multiple print nozzles, the position of each nozzle must be determined during this step.

Based on the nozzle position and orientation data and the local color matrix maps, the pixels or colorants to be applied are determined and then applied to the substrate surface in steps 910 and 911. In step 910, the unprinted pixels contained in the color matrix map are matched to specific nozzles on the print heads assigned the same color. Again, this matching process may be done on a real-time computation basis, or by table look-up. When real-time computation method is used, when a nozzle is within a predefined proximity or print target area of a pixel, it is selected for printing or firing. If the nozzle is "out of range," the pixel is skipped or passed over. Process 900 may include a combination of both and other suitable methods of determining the nozzle position and firing. In step 911, the distance from the print head array to the substrate surface is verified to ensure that the distance is within tolerance for ideal printing. If the print head is outside of the predetermined distance, then the nozzle would not fire and the pixel is not applied. In step 912, the local and/or database color matrix maps are updated to indicate which pixels have been applied. The color matrix maps in database 624 are also updated so that the general overall image application process status can be tracked and monitored. In step 913, a determination is made as to whether the entire image has been completed. An image is completed if the images for all the print regions have been applied to the target substrate surface. If not, execution returns to step 907, where the operator advances or repositions the print head array. At the completion of each print region, the PCMM arm is repositioned so that the new print region may be easily reached by the print head array. If the entire image has been applied to the substrate surface, as determined in step 913, then the process ends in step 914.

Figure 10:
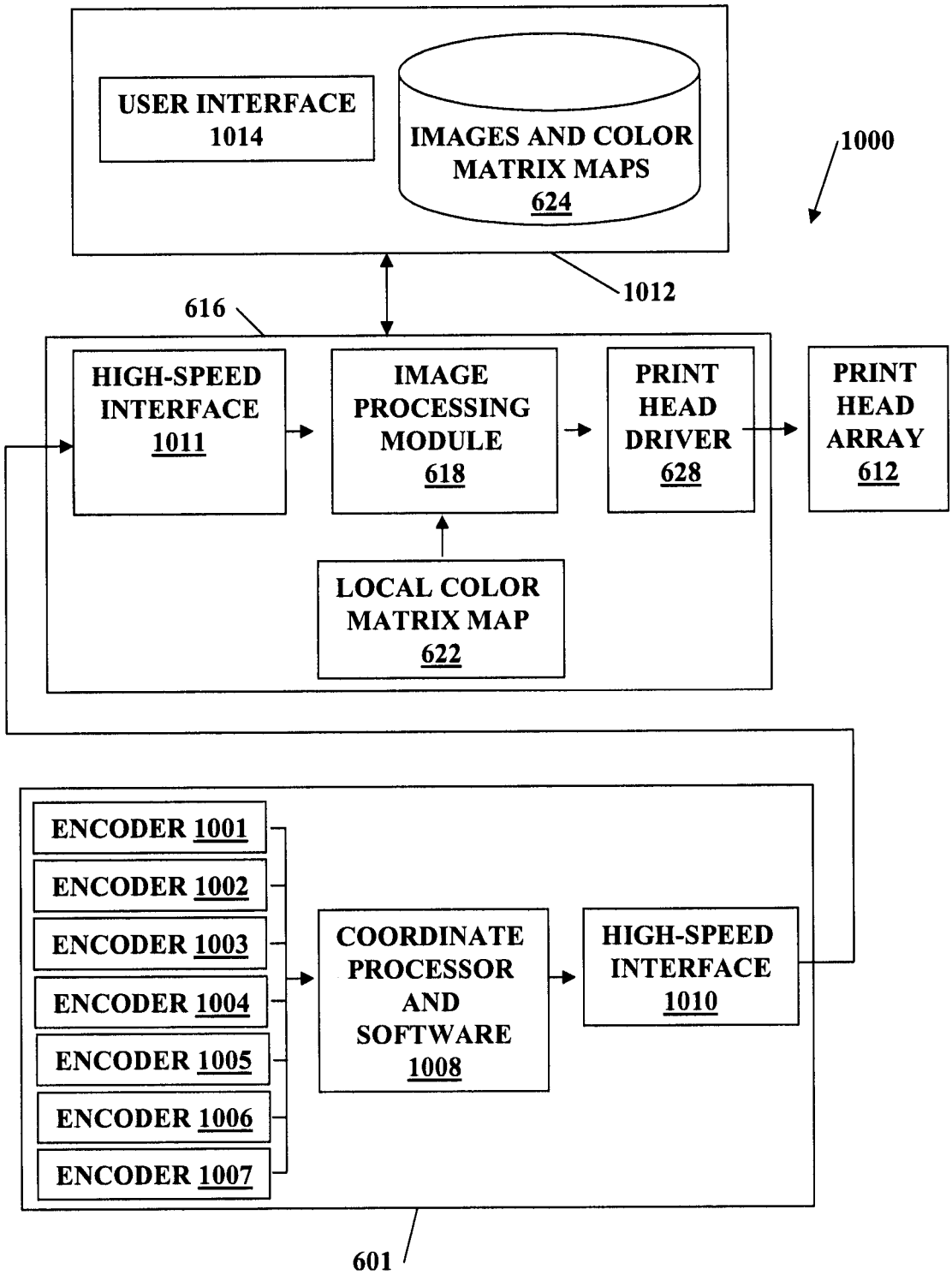
FIG. 10 is a logical block diagram of an embodiment of a system using a PCMM for applying graphics images to a surface.

FIG. 10 is a block diagram of an embodiment of a system 1000 using a PCMM for applying graphics images to a surface. Referring also to FIG. 6, PCMM 601 may include seven encoders 1007 coupled to joints 605-607 of PCMM arm 602 to provide encoder data used by coordinate processor and software 1008 to determine real-time 3D geometry data 614. Real-time geometry data 614 are provided to print processor and software 616 via high-speed interfaces or ports 1010 and 1011. As described above, high-speed interfaces 1010 and 1011 may provide high-speed wired or wireless communication between PCMM 601 and print processor and software 616. Print processor and software 616 may be controlled by a system console 1012, which includes a user interface 1014 and database 624 storing images and color matrix maps of one or more of the images. Using the real-time geometry data and color matrix maps, print processor and software determines when nozzles of each print head in the print head array should fire and apply a pixel of colorant. A nozzle will "fire" and apply the colorant of ink or paint only when it is within a predefined area corresponding to an unapplied pixel in a color matrix map. Accordingly, as the operator steadily moves the free-end of the PCMM arm and the print head array following the contours of a print region of the substrate surface, colorants of various colors are applied to form the desired color and the desired image.

As print heads fire its nozzles at the rate of 4,000 to 25,000 times per second, and the density of the drop placement is typically 90,000 to 360,000 drops per square inch, PCMM 601 must generate the geometry data fast enough to enable the real-time printing application described herein. For example, generating the geometry data at many thousands or tens of thousands of cycles per second may be needed for the real-time application described herein.

It should be noted that while FIGS. 6 and 10 show logical block diagrams of the system, the implementation of the system may integrate the hardware and software of the geometry processor and software and the print processor and software to minimize the time needed for data exchange between them and improve overall system execution speed. Further, the hardware and at least portions of the software of the geometry and print portions of the system may be incorporated and integrated into the PCMM arm with a user interface on a laptop computer or portable device coupled thereto.

While the description herein uses words such as "print," "print head," "ink," and "paint," it should be understood that the system and method described herein are applicable to apply colorants of any form. For example, the system and method described herein may be used to apply glow-in-the-dark paint or colorant.

Those skilled in the art will recognize that various elements of the current invention may be varied without departing from the invention's scope. For instance, the scaffolding system may be readily adapted to paint or print three or four surfaces, whether by integrating additional sections with the scaffolding system or by positioning the one or two surface embodiments of the invention relative to one another. Additionally, vertical drive assembly may be suited with a cherry-picker type of device that allows printing or painting at a certain distance beyond the height of the fully extended towers. Additionally, the invention may be used for surfaces other than room constructs, such as tables, screens, canvases and other surfaces to which the invention may be sized. Finally, it will be apparent to those skilled in the art that the order of the steps of the method disclosed herein may be varied without departing from the scope of the invention.

What is claimed is:

1. A method for applying an image to a substrate surface, comprising:

receiving a set of color matrix maps representing color pixel overlays forming the image;

mapping a print region on the substrate surface reachable by the free end of an articulated arm portable coordinate measuring machine having a temporarily fixed end and a free end;

effecting a positioning of a print head array relative to the substrate surface using the articulated arm portable coordinate measuring machine, the print head array comprising at least one print head having a plurality of nozzles;

receiving real-time geometry data representing the print head array position and orientation in space;

determining, in response to the real-time geometry data, the print head array position and orientation relative to the substrate surface;

determining, in response to the print head array position and orientation relative to the substrate surface and the set of color matrix maps, a set of pixels to be applied by the print head array to the substrate surface by pre-processing a sub-portion of the image having a width larger than a printing width of the print head array and then determining a set of pixels to be applied from said sub-portion;

generating instructions to the print head array, in response to the set of pixels to be applied, to actuate particular nozzles in the print head array to apply the set of pixels to the substrate surface;

completing pixel application within a print region on the substrate surface reachable by the free end of the of the portable coordinate measuring machine without moving its temporarily fixed end; and repositioning the fixed end of the portable coordinate measuring machine to enable processing a new print region that forms part of the same image.

2. The method of claim 1, wherein receiving real-time geometry data comprises receiving X, Y, and Z coordinates of the position of the print head array relative to X, Y, and Z axes, and angles A, B, and C of the orientation of the print head array relative to the X, Y, and Z axes, respectively.

3. The method of claim 1, wherein receiving real-time geometry data comprises receiving the geometry data thousands of time per second.

4. The method of claim 1, wherein effecting a positioning of a print head array relative to the substrate surface comprises calibrating the portable coordinate measuring machine with respect to the substrate surface.

5. The method of claim 4, further comprising defining a print region on the substrate surface effectively reachable by the free end of the portable coordinate measuring machine without moving its temporarily fixed end.

6. The method of claim 5, further comprising maintaining a local copy of the set of color matrix maps representing color pixel overlays forming the image in the defined print region.

7. The method of claim 1, wherein effecting a positioning of a print head array comprises advancing the print head array and following non-planar contours of the substrate surface.

8. The method of claim 1, wherein generating instructions to the print head array comprises determining whether a particular nozzle is within a predefined target print area of a pixel to be applied as defined by the color matrix maps.

9. The method of claim 8, further comprising applying an ink of a color by a particular nozzle in response to the particular nozzle being within a predefined target print area of the pixel to be applied.

10. The method of claim 1, further comprising updating the set of color matrix maps in response to the set of pixels being applied to the substrate surface.

11. A system for applying an image to a substrate surface, comprising:

a memory storing a set of color matrix maps representing color pixel overlays forming the image;

an articulated arm portable coordinate measuring machine having a base and a free end, the portable machine operable to generate real-time geometry data indicative of a position and orientation of the colorant applicator in space;

a colorant applicator provided near the free end of the portable coordinate measuring machine;

one or more processors coupled to the portable coordinate measuring machine to receive the real-time geometry data, and operable to determine the position and orientation of the colorant applicator relative to the substrate surface, pre-process a sub-portion of the image having a width larger than a printing width of the colorant applicator, and output colorant application instructions based on said position and orientation of the colorant applicator and said pre-processed sub-portion of the image; and a driver coupled to the processor and colorant applicator operable to receive colorant application instructions from the processor, and applying the colorants to the substrate surface at locations specified by the processor instructions.

12. The system of claim 11, wherein the colorant applicator comprises a print head array having at least one print head with a plurality of nozzles.

13. The system of claim 11, wherein the portable machine comprises a multi-axial articulated arm.

14. The system of claim 13, wherein the multi-axial articulated arm comprises first, second and third segments joined linearly by first, second and third joints, the first segment being coupled to the base and the third segment holding the colorant applicator.

15. The system of claim 11, further comprising a local memory storing a set of color matrix maps representing color pixel overlays forming the image in a print region.

16. The system of claim 11, wherein the free end of the portable machine is adaptable to be advanced along a planar contour of the substrate surface.

17. The system of claim 11, wherein the free end of the portable machine is adaptable to be advanced along a non-planar contour of the substrate surface.

18. A method for applying an image to a substrate surface, comprising:

selecting an image from a collection of images;

processing the selected image into a set of color matrix maps representing color pixel overlays mapped to the substrate surface;

positioning a print head array proximate to the substrate surface, the print head array having a plurality of print heads, and each print head having a plurality of nozzles operable to apply colorants of a single color;

receiving real-time geometry data representing the print head array position and orientation in space from an articulated arm coordinate measuring machine coupled to the print head array;

determining, in response to the real-time geometry data, the print head array position and orientation relative to the substrate surface;

determining, in response to the print head array position and orientation relative to the substrate surface and the set of color matrix maps, a set of pixels to be applied by the print head array to the substrate surface at the current position and orientation of the print head array by pre-processing a sub-portion of the image having a width larger than a printing width of the print head array and then determining a set of pixels to be applied from said sub-portion at said current position and orientation of the print head array;

generating instructions to the print head array, in response to the set of pixels to be applied, to actuate particular nozzles in the print head array to apply the set of pixels to the substrate surface; and advancing the print head array along contours of the substrate surface to complete the application of the image to the substrate surface.

19. The method of claim 18, wherein receiving real-time geometry data comprises receiving X, Y, and Z coordinates of the position of the print head array relative to X, Y, and Z axes, and angles A, B, and C of the orientation of the print head array relative to the X, Y, and Z axes, respectively.

20. The method of claim 18, further comprising mapping the target substrate using the arm coordinated measuring machine.

* * * * *